US006715738B1

(12) United States Patent
Braun et al.

(10) Patent No.: US 6,715,738 B1
(45) Date of Patent: Apr. 6, 2004

(54) FUEL-AIR MIXTURE CONTROL APPARATUS

(75) Inventors: Matthew A. Braun, Caro, MI (US); Masatoshi Endo, Miyagi-ken (JP); David L. Speirs, Cass City, MI (US)

(73) Assignee: Walbro Engine Management LLC, Cass City, MI (US)

( * ) Notice: Subject to any disclaimer, the term of this patent is extended or adjusted under 35 U.S.C. 154(b) by 0 days.

(21) Appl. No.: 10/254,373

(22) Filed: Sep. 25, 2002

(51) Int. Cl.[7] ..... F02M 7/18
(52) U.S. Cl. ..... 261/71; 261/DIG. 38
(58) Field of Search ..... 261/35, 71, DIG. 38, 261/DIG. 39

(56) References Cited

U.S. PATENT DOCUMENTS

| | | | | | |
|---|---|---|---|---|---|
| 3,208,739 | A | * | 9/1965 | Phillips | 261/35 |
| 3,275,306 | A | * | 9/1966 | Phillips | 261/35 |
| 3,765,657 | A | * | 10/1973 | Du Bois | 261/37 |
| 4,277,423 | A | * | 7/1981 | Noguez | 261/34.1 |
| 4,770,822 | A | * | 9/1988 | Sejimo | 261/35 |
| 4,770,823 | A | | 9/1988 | Sejimo | 261/39.1 |
| 4,814,114 | A | | 3/1989 | Charmley | 261/35 |
| 4,931,226 | A | * | 6/1990 | Ishii | 261/41.5 |
| 5,002,705 | A | | 3/1991 | Kohler | 261/35 |
| 5,133,905 | A | | 7/1992 | Woody et al. | 261/35 |
| 5,441,673 | A | * | 8/1995 | Gerhardy | 261/34.1 |
| 6,000,683 | A | | 12/1999 | Van Allen | 261/52 |
| 6,439,546 | B1 | * | 8/2002 | Galka | 261/4 |
| 6,446,939 | B1 | * | 9/2002 | Hoppe et al. | 261/35 |

* cited by examiner

*Primary Examiner*—Richard L. Chiesa
(74) *Attorney, Agent, or Firm*—Reising, Ethington, Barnes, Kisselle, P.C.

(57) ABSTRACT

A fuel-air mixture control apparatus for adjusting the mixture of fuel and air that a carburetor provides to an internal combustion engine. A mixing passage provides a fuel-air mixture to one or more combustion chambers of an internal combustion engine. A main fuel supply passage provides fluid communication between a fuel source and the mixing passage through a main fuel nozzle. An idle fuel supply passage provides fluid communication between a fuel source and the mixing passage through an idle fuel nozzle. An idle fuel ratio control valve adjusts the proportion of fuel drawn into the mixing passage through the idle fuel supply passage to the flow rate of air drawn into the mixing passage. The idle fuel supply passage is in fluid communication with the main fuel nozzle. Vacuum pressure induced by flow rates across the main fuel nozzle, which exceed a predetermined flow rate, precludes idle fuel flow into the mixing passage. As such, the position of the idle fuel ratio control valve cannot affect the fuel air mixture at throttle settings that provide a flow of fuel and air equal to or exceeding the predetermined value. A main fuel flow ratio control valve adjusts the proportion of fuel drawn into the mixing passage through the main fuel supply passage to the flow rate of air drawn into the mixing passage.

8 Claims, 4 Drawing Sheets

FUEL-AIR MIXTURE CONTROL APPARATUS

BACKGROUND OF THE INVENTION

1. Field of the Invention

This invention relates generally to a fuel-air mixture control apparatus for adjusting the mixture of fuel and air that a carburetor provides to an internal combustion engine.

2. Description of the Related Art Including Information Disclosed Under 37 CFR 1.97 and 1.98

Known carburetors generally include fuel-air mixture control apparati. A mixture control apparatus of this type will typically include a mixing passage that provides a fuel-air mixture to one or more combustion chambers of an internal combustion engine. Carburetors also generally include throttle valve plates and choke valve plates pivotally supported in their mixing passages to control the flow rate of the fuel-air mixture through the mixing passages. Main fuel supply passages admit fuel into the mixing passages through main fuel nozzles. Some carburetors also include an idle fuel supply passage that admits fuel to a mixing passage through an idle fuel nozzle to provide sufficient fuel to support idle operation of an internal combustion engine. Idle fuel ratio control valves in the form of valve needles are typically used to adjust the proportion of fuel drawn into the mixing passage to the flow rate of air drawn into the mixing passage.

It is known for small internal-combustion appliance engines to have carburetors designed for operation at only two throttle settings: idle and wide open throttle. For this reason, and because emissions from such engines are tested only at the wide-open throttle setting, it is desirable to provide means for preventing changes in idle fuel-air mixture setting from changing the fuel-air mixture setting at wide-open throttle.

For example, a line of carburetors manufactured by the assignee of the present invention and designated WT-283C carburetors, include a fuel-air mixture control apparatus that shuts-off idle fuel flow at wide-open throttle. As is schematically shown in FIG. 9 of the drawings, the apparatus includes a mixing passage 1 formed in a carburetor body 2 and a throttle valve plate 3 pivotally supported in the mixing passage 1. Main and idle fuel supply passages 4, 5 are formed in the carburetor body 2 and provide fuel to the mixing passage 1 through respective main and idle fuel nozzles 6, 7. An idle fuel ratio control valve 8 disposed in the carburetor body 2 adjusts the proportion of fuel drawn into the mixing passage 1 to the flow rate of air drawn into the mixing passage 1 at idle engine operation. The idle fuel supply passage 5 is in fluid communication with the main fuel nozzle 6 such that vacuum pressure induced by air flow rates across the main fuel nozzle 6 at or approaching wide-open throttle, precludes idle fuel flow into the mixing passage 1 through the main fuel nozzle 6. Consequently, the position of the idle fuel flow ratio control valve 8 cannot affect the fuel air mixture at throttle settings at or approaching wide-open. Because the throttle 3 must be positioned close to wide-open to produce sufficient vacuum pressure to halt idle fuel flow, idle mixture settings cannot affect the fuel-air mixture in the mixing passage 1 at the wide-open throttle settings. However, a fuel-air mixture control apparatus constructed according to WT-283C type carburetors does not provide for adjustment of the fuel to air ratio at throttle settings approaching wide-open. As such, changes in air density due to temperature changes (for example) cannot be compensated for at throttle settings approaching wide-open.

BRIEF SUMMARY OF THE INVENTION

The invention is a fuel-air mixture control apparatus for adjusting the mixture of fuel and air that a carburetor provides to an internal combustion engine. The apparatus includes a carburetor body and a mixing passage preferably formed in the carburetor body. The mixing passage 1 is configured to provide a fuel-air mixture to one or more combustion chambers of an internal combustion engine. A main fuel supply passage provides fluid communication between a fuel source and the mixing passage 1 through a main fuel nozzle. An idle fuel supply passage provides fluid communication between a fuel source and the mixing passage 1 through an idle fuel nozzle. An idle fuel ratio control valve is configured to adjust the proportion of fuel drawn into the mixing passage 1 through the idle fuel supply passage to the flow rate of air drawn into the mixing passage 1. The idle fuel supply passage is in fluid communication with the main fuel nozzle and is configured such that vacuum pressure induced by air flow rates across the main fuel nozzle, which exceed a predetermined flow rate, precludes idle fuel flow into the mixing passage 1. A main fuel flow ratio control valve is configured to adjust the proportion of fuel drawn into the mixing passage 1 through the main fuel supply passage to the flow rate of air through the mixing passage 1.

Objects, features and advantages of this invention include providing a fuel-air mixture control apparatus that allows an operator to adjust the high speed mixture of fuel and air that a carburetor provides to an internal combustion engine at throttle settings approaching wide-open throttle while preventing idle fuel flow from affecting the high speed mixture, that allows an operator to select an optimum high speed fuel-air mixture setting without having to compensate for whatever idle fuel mixture setting was selected, that allows an operator to select any idle fuel mixture setting and then select an optimum main fuel-air mixture setting without having to compensate for whatever idle fuel mixture setting was selected; and that allows an operator to later change the idle fuel mixture setting without having to make a corresponding correction to the main fuel mixture setting to compensate for the change. Therefore, idle fuel flow has no effect on engine exhaust emissions at wide-open throttle settings.

BRIEF DESCRIPTION OF THE SEVERAL VIEWS OF THE DRAWINGS

These and other objects, features and advantages of this invention will be apparent from the following detailed description of the preferred embodiment(s) and best mode, appended claims, and accompanying drawings in which:

DETAILED DESCRIPTION OF INVENTION EMBOBIMENT(S)

Figure 8:
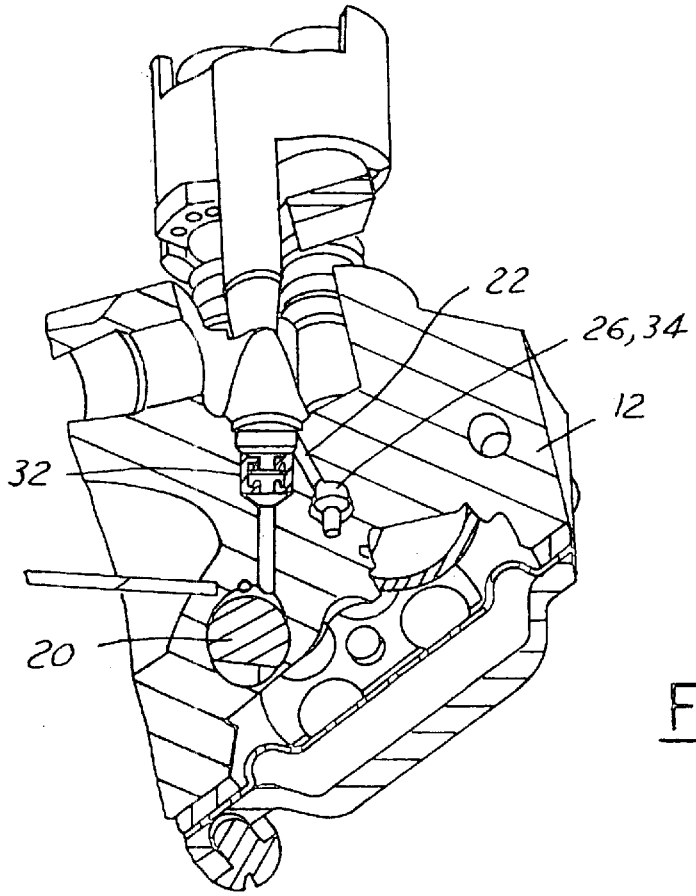
FIG. 8 is a cross-sectional view of the fragmentary portion of the apparatus of FIG. 1 shown in FIG. 7.
Figure 9:
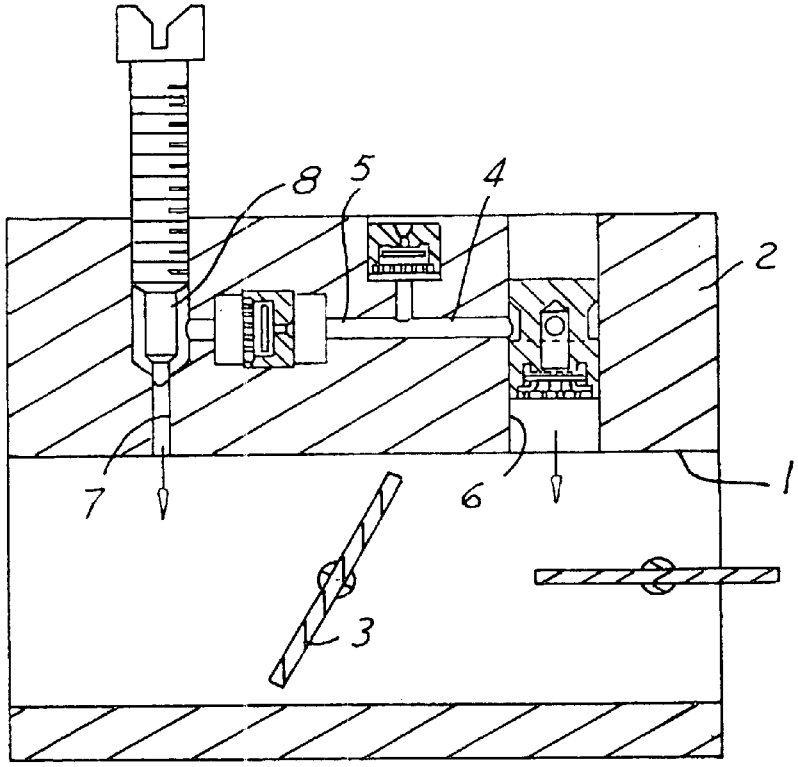
(PRIOR ART) FIG.9
FIG. 9 is a schematic cross-sectional view of a prior art fuel air mixture control apparatus.
Figure 10:
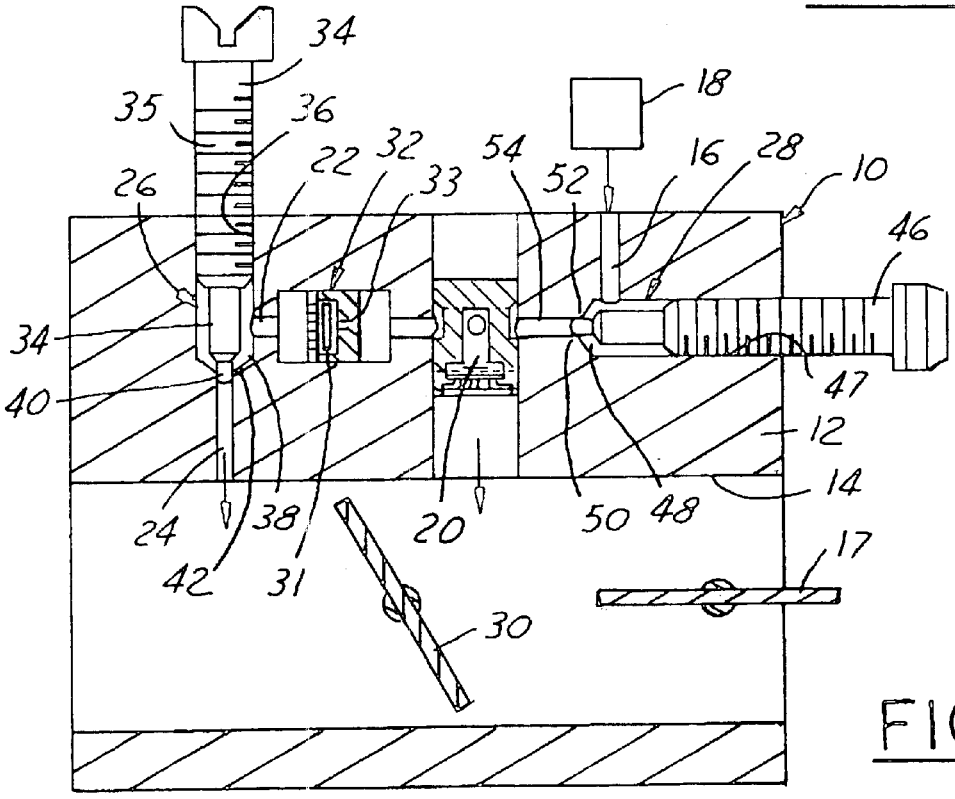
FIG. 10 is a schematic cross-sectional view of the fuel air mixture control apparatus of FIG. 1.

An apparatus for controlling the mixture of a fuel and air provided to an internal combustion engine is shown at 10 in the drawings. As best shown in FIGS. 1–8, the apparatus 10 includes a carburetor body 12 and a mixing passage 14 formed in the carburetor body 12 and configured to provide a fuel air mixture to one or more combustion chambers of an internal combustion engine (not shown). The apparatus 10 also includes a main fuel supply passage 16 that provides fluid communication between a fuel source 18 and the mixing passage 14 through a main fuel nozzle 20. As shown in FIGS. 8 and 10, an idle fuel supply passage 22 provides fluid communication between a fuel source 18 and the mixing passage 14 through an idle fuel nozzle 24. An idle fuel ratio control valve 26 is also disposed in the carburetor body 12. The idle fuel ratio control valve 26 adjusts the idle fuel flow rate (rate of fuel being drawn into the mixing passage 14 through the idle fuel supply passage 22) to the flow rate of air concurrently flowing through the mixing passage 14, i.e., the idle fuel to air ratio. The idle fuel supply passage 22 is in fluid communication with the main fuel nozzle 20. The relationship between the idle fuel supply passage 22 and the main fuel nozzle 20 is such that vacuum pressure induced by air flow rates across the main fuel nozzle 20, which exceed a predetermined flow rate, precludes idle fuel flow into the mixing passage 14. Consequently, the position of the idle fuel ratio control valve 26 cannot affect the fuel air mixture at throttle settings that provide a flow of fuel and air equal to or exceeding the predetermined value.

The apparatus 10 also includes a main fuel flow ratio control valve 28 disposed in the carburetor body 12. The main fuel flow ratio control valve 28 adjusts the main fuel flow rate (rate of fuel being drawn into the mixing passage 14 through the main fuel supply passage 16) relative to the flow rate of air concurrently being drawn into the mixing passage 14, i.e., the main fuel to air ratio.

Figure 2:
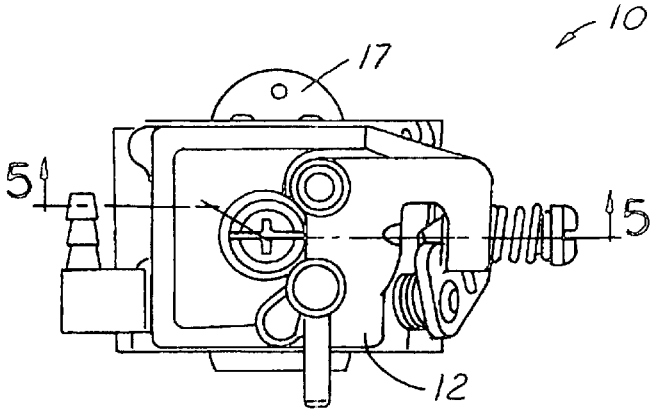
FIG. 2 is a top view of the apparatus of FIG. 1.
Figure 1:
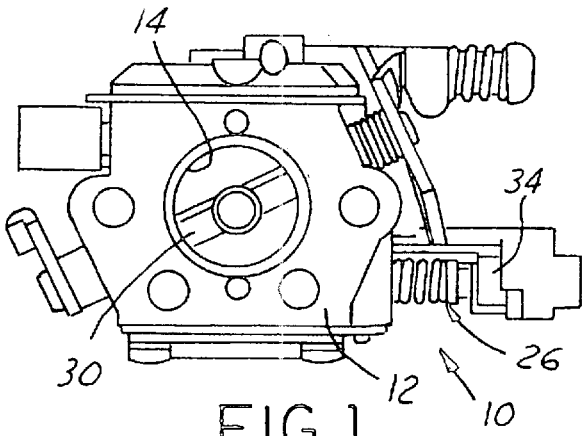
FIG. 1 is front view of a fuel air mixture control apparatus constructed according to the invention.
Figure 3:
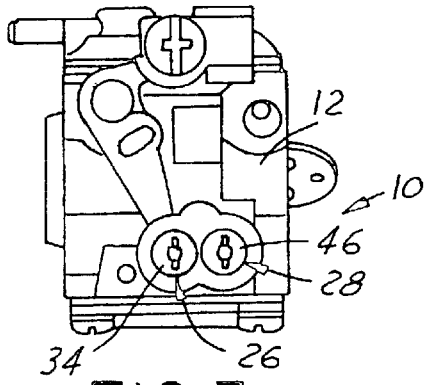
FIG. 3 is a right side view of the apparatus of FIG. 1.
Figure 4:
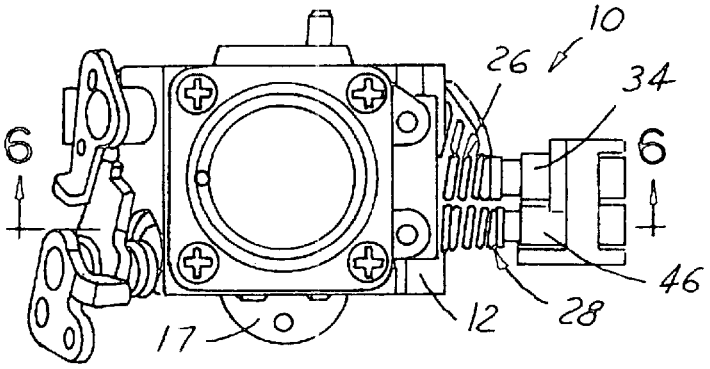
FIG. 4 is a bottom view of the apparatus of FIG. 1.
Figure 5:
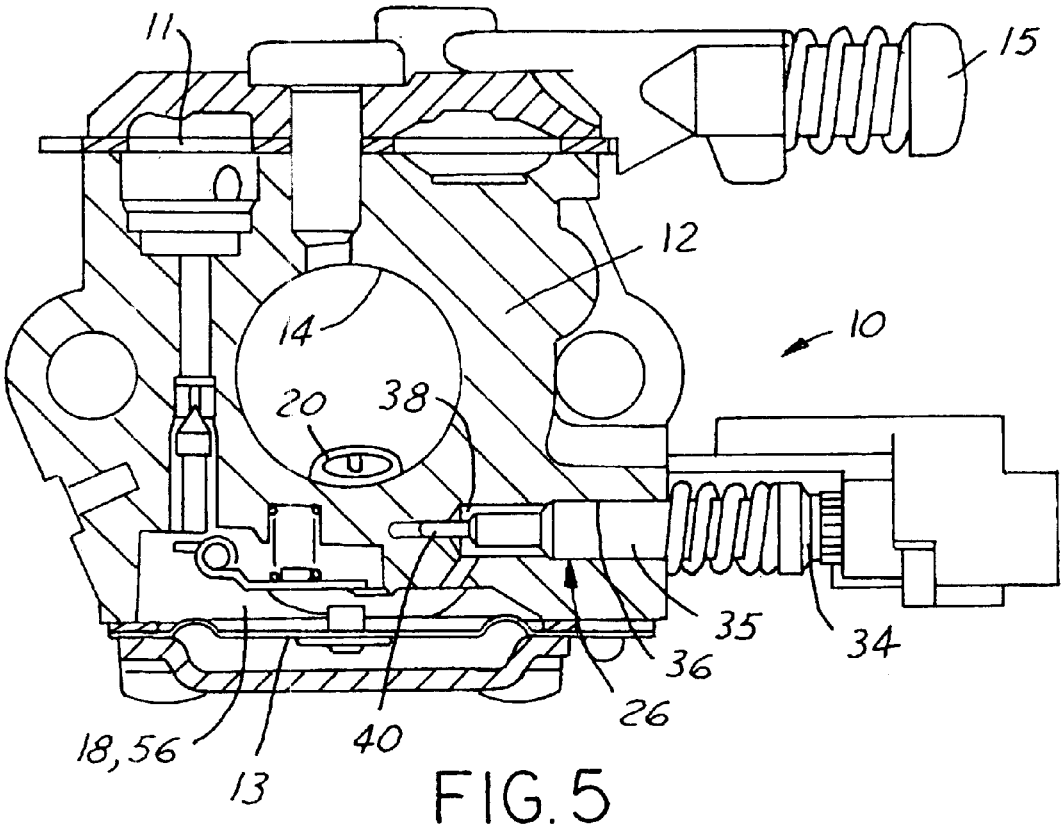
FIG. 5 is a partial cross-sectional view of the apparatus of FIG. 1 taken along line 5—5 of FIG. 2.

Described in more detail, and as best shown in FIG. 5, the embodiment shown in the drawings also includes a diaphragm fuel pump 11, a fuel metering valve 13, a throttle plate idle adjustment screw 15, and, as best shown in FIG. 10, a choke plate 17. The structures and operation of these and other carburetor components are generally the same as those disclosed in U.S. Pat. No. 4,814,114, which is assigned to the assignee of the present invention and is incorporated herein by reference.

A throttle valve 30 is supported in the mixing passage 14 and controls the flow rate of the fuel air mixture through the mixing passage 14. The throttle valve 30 is rotatable between a "wide open" position providing maximum flow through the mixing passage 14 and an idle position substantially restricting the flow of fuel and air through the passage 14. The idle fuel supply passage 22 and the main fuel nozzle 20 are arranged such that idle fuel flow into the mixing passage 14 is precluded by a magnitude of vacuum pressure that is experienced at flow rates across the main fuel nozzle 20 produced by a wide open throttle setting of the throttle valve 30.

The idle fuel supply passage 22 is in fluid communication with the main fuel supply passage 16 via the main fuel nozzle 20. The idle fuel supply passage 22 draws idle fuel from fuel that has been drawn into the main fuel nozzle 20 from the main fuel supply passage 16.

As best shown in FIG. 10, a one-way idle check valve 32 is fitted in the idle fuel supply passage 22 and includes a movable disk 31 that engages a seat to close an opening 33 through the valve 32. The one-way idle check valve 32 is positioned to halt the flow of fuel from the idle fuel supply passage 22 into the main fuel nozzle 20. As a result, when mixing passage air flow rates across the main fuel nozzle 20 increase to the point where resulting vacuum pressure begins to draw fuel into the mixing passage from the idle fuel supply passage 22, the idle check valve 32 closes, precluding the back flow of fuel through the idle fuel supply passage 22 into the main fuel nozzle 20.

As shown in FIGS. 5 and 10, the idle fuel ratio control valve 26 includes an idle mixture control needle 34 with a threaded shaft 35 received within a complimentary threaded bore 36 formed in the carburetor body 12. An inner end 38 of the threaded bore 36 intersects and forms a portion of the idle fuel supply passage 22. The idle mixture control needle 34 and complimentary bore 36 are positioned such that reciprocal rotational motion of the idle mixture control needle 34 and resulting reciprocal axial motion of the needle 34 within the bore 36 adjusts the flow area between a needle end 40 of the valve 26 and a corresponding portion of the bore 36. As best shown in FIG. 10, idle fuel flow is shut off at the innermost end of idle mixture control needle travel when a distal inner end 40 of the needle 34 engages and blocks an opening 42 into an exit portion 24 of the idle fuel supply passage 22. Idle fuel flow is restored and increases as the needle 34 is backed-out and the distal inner end 40 of the needle 34 moves away from the opening 42.

Figure 6:
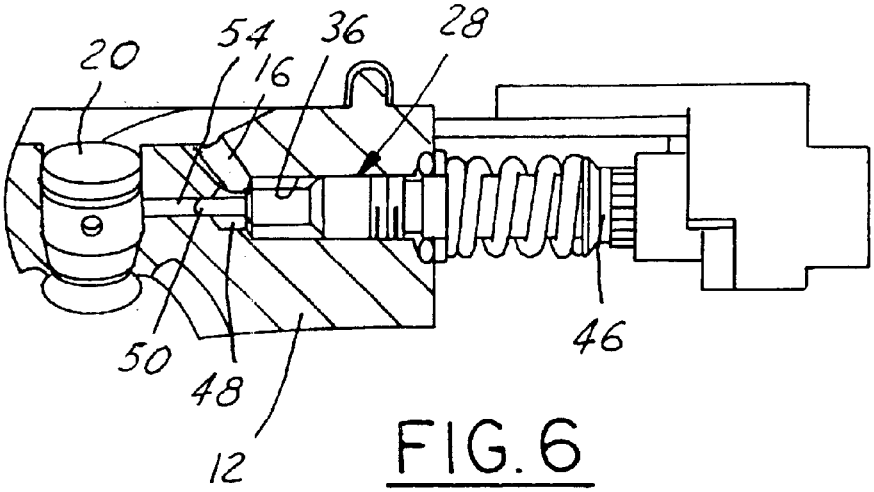
FIG. 6 is a partial cross-sectional fragmentary view of the apparatus of FIG. 1 taken along line 6—6 of FIG. 4.
Figure 7:
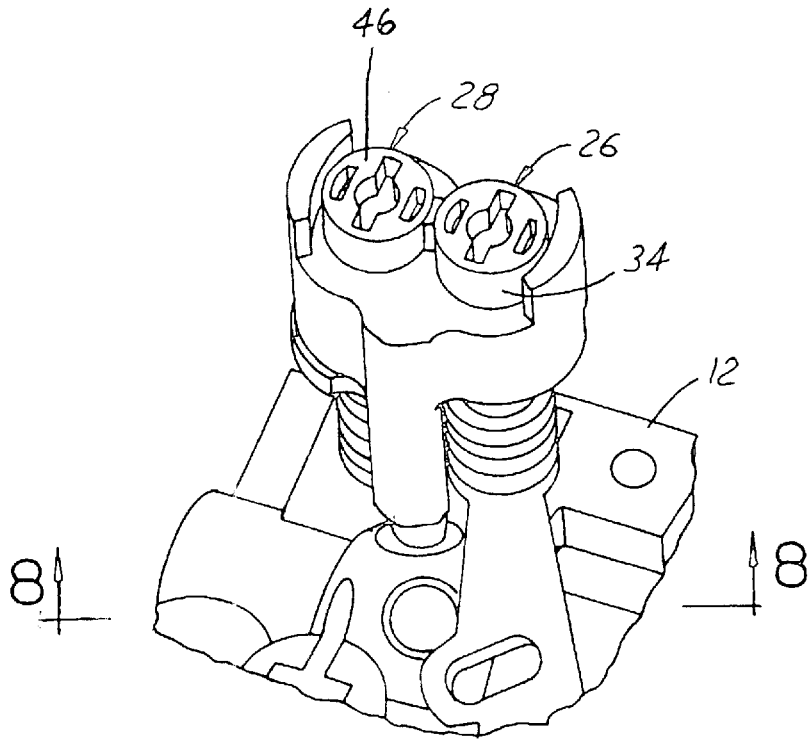
FIG. 7 is an isometric fragmentary view of the apparatus of FIG. 1 showing a portion of the apparatus including fuel mixture needle valves.

As shown in FIGS. 6 and 10, the main fuel ratio control valve 28 includes a main mixture control needle 46. The main mixture control needle 46 is threadedly engaged within a complementary threaded bore 47 formed in the carburetor body 12. An inner end 48 of the complementary bore 47 intersects the main fuel supply passage 16. As with the idle fuel ratio control valve needle 34, rotation and resulting reciprocal axial motion of the main fuel ratio control needle 46 within the complementary bore 47 adjusts the flow area between an inner end 50 of the needle 46 and a corresponding portion of the bore 47. Main fuel flow is shut off at the innermost end of main fuel ratio control needle travel when the inner end 50 of the needle 46 engages and blocks the opening 52 into an exit portion 54 of the main fuel supply passage 16. Main fuel flow is restored and increases as the needle 46 is backed-out and the distal inner end 50 of the needle 46 moves away from the opening 52.

As shown in FIGS. 5, 6, and 8, the main fuel supply passage 16 is formed in the carburetor body 12 and provides fluid communication between a metering chamber 56 formed in the carburetor body 12 and the main fuel nozzle 20. Similarly, the idle fuel supply passage 22 is formed in the carburetor body 12 and provides fluid communication between the main fuel nozzle 20 and the idle nozzle 24 to provide sufficient fuel to support idle operation of an internal combustion engine.

At idle, fuel flows from the metering chamber 56 of the carburetor into the main fuel supply passage 16. The fuel then passes the main fuel ratio control valve needle 46 and flows to the main fuel nozzle 20. From the main fuel nozzle 20 the fuel flows into the idle fuel supply passage 22, through the idle check valve 32, and past the idle mixture control needle 34. After passing the idle mixture control needle 34, the fuel exits through the idle fuel nozzle 24 into the mixing passage 14.

At wide open throttle, vacuum is applied to the main fuel nozzle 20. The vacuum draws fuel both from the main fuel supply passage 16 and from the idle fuel supply passage 22. This causes the flow of fuel through the idle fuel supply passage 22 to reverse, which causes the idle check valve 32 to close. Once the idle check valve 32 has closed, there can be no contribution of fuel from the idle fuel supply passage 22 to the mixing passage 14 through main fuel nozzle 20.

This description is intended to illustrate certain embodiments of the invention rather than to limit the invention. Therefore, it uses descriptive rather than limiting words. Obviously, it's possible to modify this invention from what the description teaches. Within the scope of the claims, one may practice the invention other than as described.

We claim:

1. An apparatus for controlling a fuel-air mixture provided to an internal combustion engine, the apparatus comprising:

a body;

a mixing passage formed in the body and configured to provide a fuel-air mixture to one or more combustion chambers of an internal combustion engine;

a main fuel supply passage providing fluid communication between a fuel source and the mixing passage through a main fuel nozzle;

an idle fuel supply passage providing fluid communication between a fuel source and the mixing passage through an idle fuel nozzle;

an idle fuel ratio control valve carried by the body and configured to adjust the proportion of fuel provided into the mixing passage through the idle fuel supply passage to the flow rate of air through the mixing passage;

the idle fuel supply passage being in fluid communication with the main fuel nozzle and configured such that vacuum pressure induced by flow rates across the main fuel nozzle, which exceed a predetermined flow rate, precludes idle fuel flow into the mixing passage; and a main fuel flow ratio control valve carried by the body and configured to adjust the proportion of fuel provided into the mixing passage through the main fuel supply passage to the flow rate of air through the mixing passage.

2. A fuel-air mixture control apparatus as defined in claim 1 in which:

a throttle valve is supported in the mixing passage and configured to control the flow rate of the fuel-air mixture through the mixing passage; and the idle fuel supply passage and main fuel nozzle are configured such that idle fuel flow into the mixing passage is precluded by an amount of vacuum pressure experienced at flow rates across the main fuel nozzle produced by a wide-open throttle setting of the throttle valve.

3. A fuel-air mixture control apparatus as defined in claim 1 in which:

the idle fuel supply passage is in fluid communication with the main fuel supply passage via the main fuel nozzle; and the idle fuel supply passage is configured and positioned to draw idle fuel from fuel that has been drawn into the main fuel nozzle from the main fuel supply passage.

4. A fuel-air mixture control apparatus as defined in claim 1 in which a one-way check valve is disposed in the idle fuel supply passage and is positioned to preclude the flow of fuel from the idle fuel supply passage into the main fuel nozzle.

5. A fuel-air mixture control apparatus as defined in claim 1 in which the idle fuel ratio control valve includes a needle threadedly engaged within a complementary bore formed in the body and intersecting the idle fuel supply passage such that reciprocal axial motion of the needle within the bore adjusts the effective flow area of the idle fuel ratio control valve.

6. A fuel-air mixture control apparatus as defined in claim 1 in which the main fuel ratio control valve includes a needle threadedly engaged within a complementary bore formed in the body and intersecting the main fuel supply passage such that reciprocal axial motion of the needle within the bore adjusts the effective flow area of the main fuel ratio control valve.

7. A fuel-air mixture control apparatus as defined in claim 1 in which the main fuel supply passage is formed in the body and provides fluid communication between a metering chamber of the carburetor and the main fuel nozzle.

8. A fuel-air mixture control apparatus as defined in claim 1 in which the idle fuel supply passage is formed in the body and provides fluid communication between the main fuel nozzle and the mixing passage through an idle fuel nozzle to provide sufficient fuel to support idle operation of an internal combustion engine.

* * * * *